US005829157A

United States Patent [19]

Gittens et al.

[11] Patent Number: 5,829,157

[45] Date of Patent: Nov. 3, 1998

[54] UNIFORM HEAT DISTRIBUTING HEAT PROTECTING SYSTEM FOR HAIR DRYING

[76] Inventors: Gem Gittens, 5 Doe Dr., Seale, Ala. 36875; Diane Gosha, 1110 Dunbar Ave., Columbus, Ga. 31906

[21] Appl. No.: 888,265

[22] Filed: Jul. 3, 1997

[51] Int. Cl.[6] ..... A45D 24/10

[52] U.S. Cl. ..... 34/99

[58] Field of Search ..... 34/95, 96, 97, 34/99, 100, 101; 392/380, 382, 383; 132/220, 221, 222, 274

[56] References Cited

U.S. PATENT DOCUMENTS 3,313,036 4/1967 Fortune ..... 34/99
3,383,700 5/1968 Taylor ..... 34/99
3,726,021 4/1973 Waters et al. ..... 34/99
4,259,566 3/1981 Kobayashi ..... 34/99 X

*Primary Examiner*—Henry A. Bennett
*Assistant Examiner*—Steve Gravini

[57] ABSTRACT

A new Uniform Heat Distributing Head Protecting System for providing a cap which protects a user's ears and uniformly heats a chemical applied to the user's hair. The inventive device includes a cover formed to snugly engage a head, an elastic band attached to the cover, a pair of arcuate support members attached to the cover, a heat control switch, and three heating elements secured within the cap for heating the chemical applied to the hair. The three heating elements comprise a high temperature heating element, a medium temperature heating element, and a low temperature heating element controlled by the heat control switch.

9 Claims, 3 Drawing Sheets

FIG 3
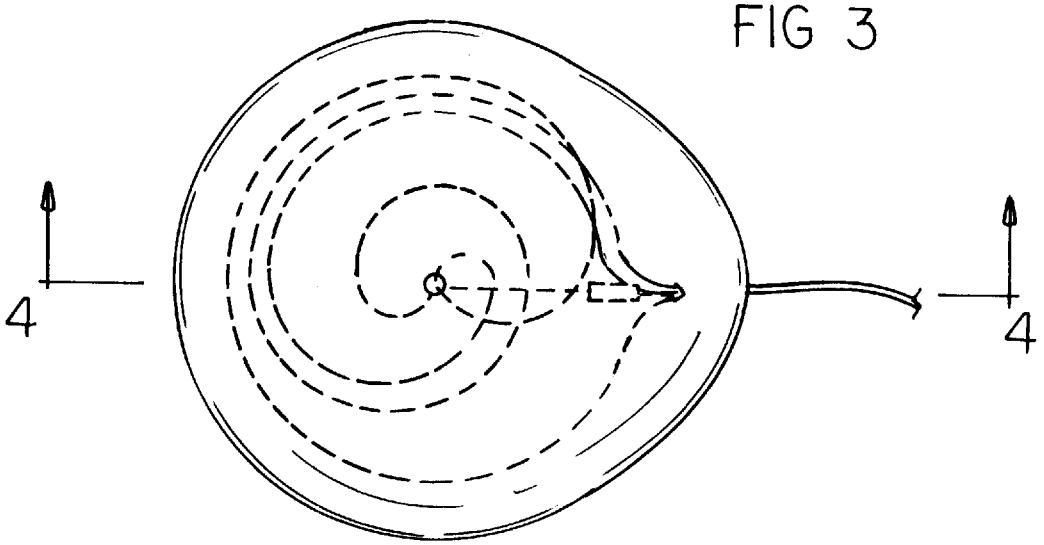
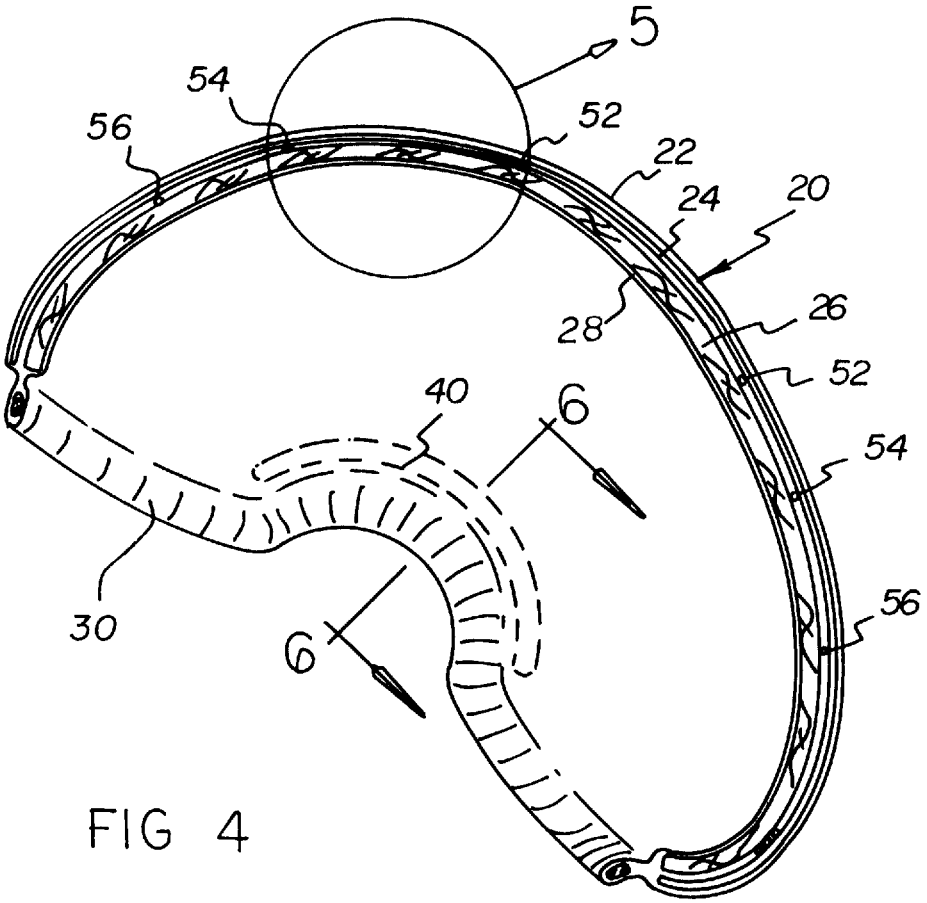
FIG 4

UNIFORM HEAT DISTRIBUTING HEAT PROTECTING SYSTEM FOR HAIR DRYING

BACKGROUND OF THE INVENTION

1. Field of the Invention

The present invention relates to Salon Hat Devices and more particularly pertains to a new Uniform Heat Distributing Head Protecting System for providing a cap which protects a user's ears and uniformly heats a chemical applied to the user's hair.

2. Description of the Prior Art

The use of Salon Hat Devices is known in the prior art. More specifically, Salon Hat Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Salon Hat Devices include U.S. Pat. No. 4,662,084; U.S. Pat. No. 4,112,591; U.S. Design Pat. No. 339,880; U.S. Pat. No. 4,658,511; U.S. Pat. No. 4,704,744 and U.S. Pat. No. 4,542,595.

While these devices fulfill their respective, particular objectives and requirements, the aforementioned patents do not disclose a new Uniform Heat Distributing Head Protecting System. The inventive device includes a cover formed to snugly engage a head, an elastic band attached to the cover, a pair of arcuate support members attached to the cover, a heat control switch, and three heating elements secured within the cap for heating the chemical applied to the hair.

In these respects, the Uniform Heat Distributing Head Protecting System according to the present invention substantially departs from the conventional concepts and designs of the prior art, and in so doing provides an apparatus primarily developed for the purpose of providing a cap which protects a user's ears and uniformly heats a chemical applied to the user's hair.

SUMMARY OF THE INVENTION

In view of the foregoing disadvantages inherent in the known types of Salon Hat Devices now present in the prior art, the present invention provides a new Uniform Heat Distributing Head Protecting System construction wherein the same can be utilized for providing a cap which protects a user's ears and uniformly heats a chemical applied to the user's hair.

The general purpose of the present invention, which will be described subsequently in greater detail, is to provide a new Uniform Heat Distributing Head Protecting System apparatus and method which has many of the advantages of the Salon Hat Devices mentioned heretofore and many novel features that result in a new Uniform Heat Distributing Head Protecting System which is not anticipated, rendered obvious, suggested, or even implied by any of the prior art Salon Hat Devices, either alone or in any combination thereof.

To attain this, the present invention generally comprises a cover formed to snugly engage a head, an elastic band attached to the cover, a pair of arcuate support members attached to the cover, a heat control switch, and three heating elements secured within the cap for heating the chemical applied to the hair.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Uniform Heat Distributing Head Protecting System apparatus and method which has many of the advantages of the Salon Hat Devices mentioned heretofore and many novel features that result in a new Uniform Heat Distributing Head Protecting System which is not anticipated, rendered obvious, suggested, or even implied by any of the prior art Salon Hat Devices, either alone or in any combination thereof.

It is another object of the present invention to provide a new Uniform Heat Distributing Head Protecting System which may be easily and efficiently manufactured and marketed.

It is a further object of the present invention to provide a new Uniform Heat Distributing Head Protecting System which is of a durable and reliable construction.

An even further object of the present invention is to provide a new Uniform Heat Distributing Head Protecting System which is susceptible of a low cost of manufacture with regard to both materials and labor, and which accordingly is then susceptible of low prices of sale to the consuming public, thereby making such Uniform Heat Distributing Head Protecting System economically available to the buying public.

Still yet another object of the present invention is to provide a new Uniform Heat Distributing Head Protecting System which provides in the apparatuses and methods of the prior art some of the advantages thereof, while simultaneously overcoming some of the disadvantages normally associated therewith.

Still another object of the present invention is to provide a new Uniform Heat Distributing Head Protecting System for providing a cap which protects a user's ears and uniformly heats a chemical applied to the user's hair.

Yet another object of the present invention is to provide a new Uniform Heat Distributing Head Protecting System which includes a cover formed to snugly engage a head, an elastic band attached to the cover, a pair of arcuate support members attached to the cover, a heat control switch, and three heating elements secured within the cap for heating the chemical applied to the hair.

Still yet another object of the present invention is to provide a new Uniform Heat Distributing Head Protecting System that provides sufficient heat though out the middle portion of the head.

Even still another object of the present invention is to provide a new Uniform Heat Distributing Head Protecting System that fits snugly to a user's head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein:

FIG. 3 is a top view of the present invention.

FIG. 4 is a cross sectional view taken along line 4—4 of FIG. 3.

DESCRIPTION OF THE PREFERRED EMBODIMENT

Figure 1:
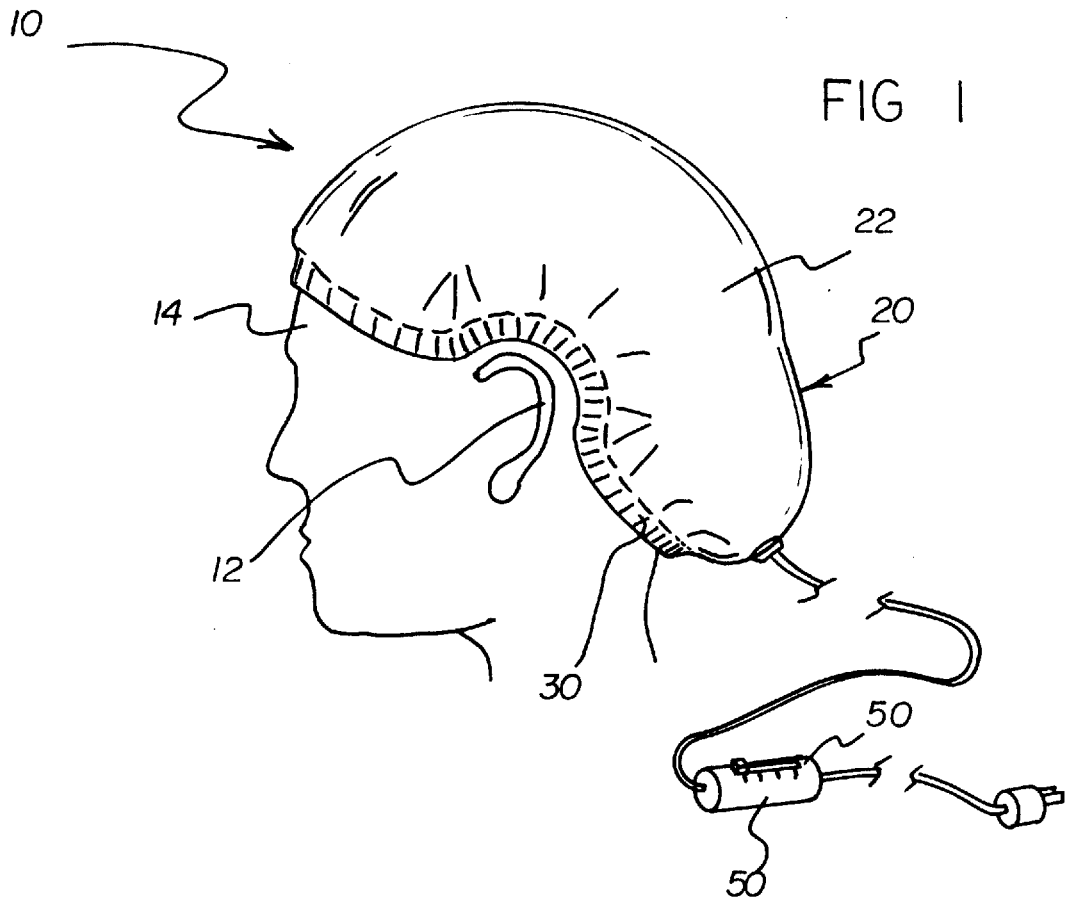
FIG. 1 is a side view of a new Uniform Heat Distributing Head Protecting System according to the present invention.
Figure 2:
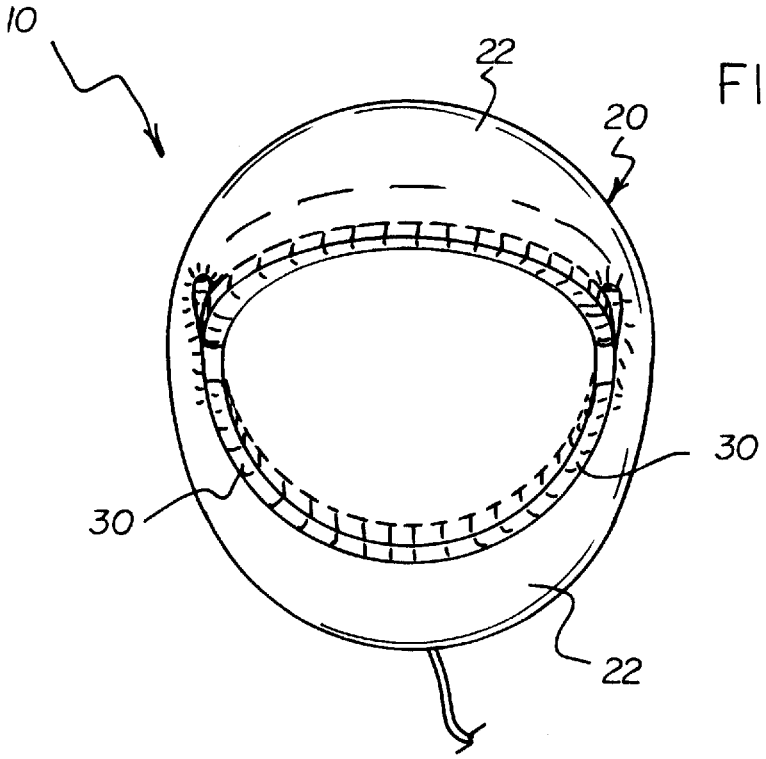
FIG. 2 is a front view of the present invention.

With reference now to the drawings, and in particular to FIGS. 1 through 7 thereof, a new Uniform Heat Distributing Head Protecting System embodying the principles and concepts of the present invention and generally designated by the reference numeral 10 will be described.

More specifically, it will be noted that the Uniform Heat Distributing Head Protecting System 10 comprises a cover 20 formed to snugly engage an upper portion of a user's head 14 thereby enclosing hair from the user. The cover 20 includes a pair of notches opposite of one another for receiving ears 12 from the user as shown in FIGS. 1 and 4 of the drawings. An elastic band 30 is secured to an outer perimeter of the cover 20 for retaining the cover 20 snugly engaging the user's head 14. A heating means is secured within the cover 20 for applying an adjustable uniform heat to chemical applied to the hair of the user.

As shown in FIGS. 3 through 7 of the drawings, the heating means comprises a heat control switch 50. A high heating element 52 is electrically connected to the heat control switch 50 and positioned within the cover 20. A medium heating element 54 is electrically connected to the heat control switch 50 and positioned within the cover 20. A low heating element 56 is electrically connected to the heat control switch 50 and positioned within the cover 20. A ground wire 59 is electrically connected to the heat control switch 50 at one end thereof, and electrically connected to the high, medium and low heating elements 52, 54 and 56. A heat sensitive fuse 58 is electrically connected within the ground wire 59 for opening a circuit when a temperature within the cover 20 rises above a predetermined level.

Figure 5:
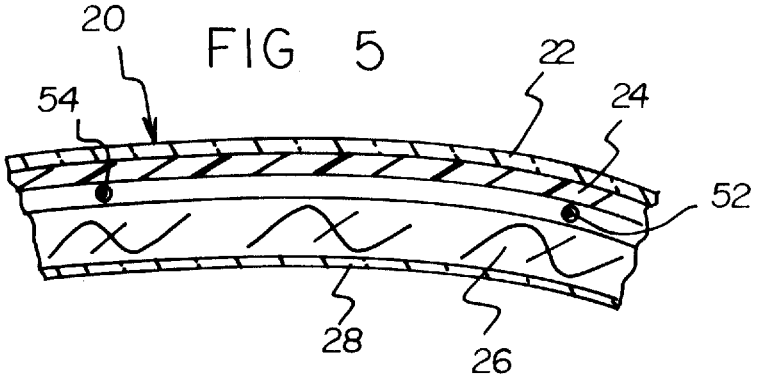
FIG. 5 is a magnified view from FIG. 4.
Figure 6:
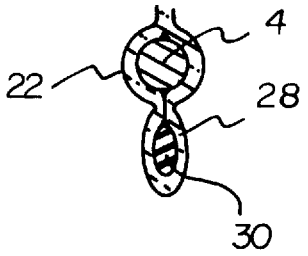
FIG. 6 is a cross sectional view taken along line 6—6 of FIG. 4.
Figure 7:
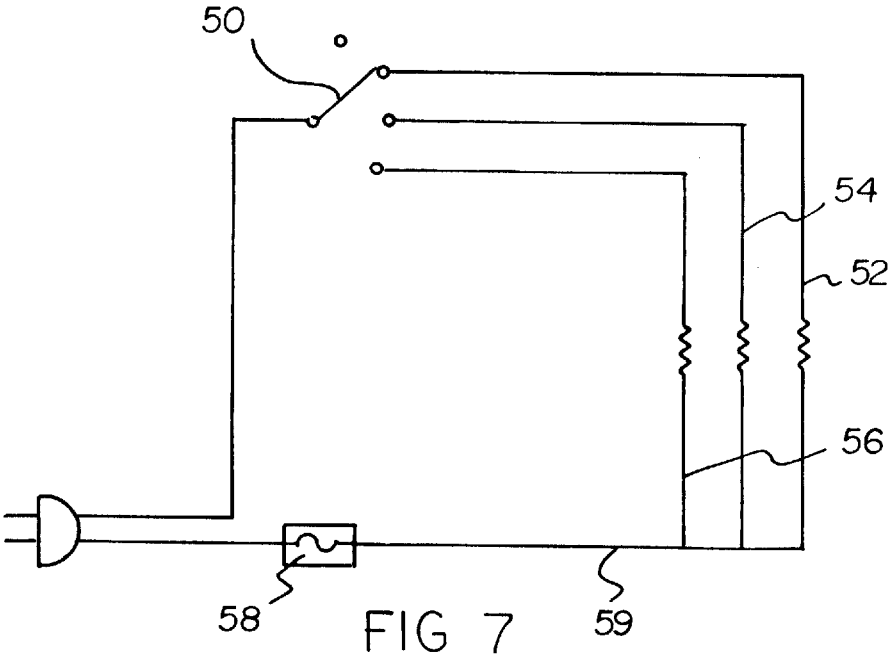
FIG. 7 is a schematic illustration of the present invention.

As shown in FIGS. 4 and 6 of the drawings, a pair of arcuate support members 40 are secured within the cover 20 adjacent and parallel to the respective pair of notches for supporting the cover 20 above the ears 12 of the user. The arcuate support members 40 are constructed from a rigid plastic. As best shown in FIG. 5 of the drawings, the cover 20 comprises an outer transparent plastic sheet 22 and an inner transparent plastic sheet 28 forming an interior portion. A transparent vinyl sheet 24 is secured to the outer transparent plastic sheet 22 within the interior portion. A fleece sheet 26 is secured to the inner transparent plastic sheet 28 within the interior portion, wherein the high, medium and low heating elements 52, 54 and 56 are positioned mesially the fleece sheet 26 and the transparent vinyl 24 sheet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A uniform heat distribution head protecting system comprising:

a cover formed to snugly engage an upper portion of a user's head thereby enclosing hair of said user;

said cover including a pair of notches opposite of one another, said notches being for receiving ears of said user;

an elastic band secured to an outer perimeter of said cover, said elastic band being for retaining said cover in snug engagement with said user's head to trap air between said cover and the head of the user; and a heating means for applying an adjustable uniform heat to a chemical applied to said hair of said user, said heating means being integrally formed in said cover in a substantially uniform arrangement such that the hair of the user is uniformly exposed to the heat produced by said heating means, wherein said cover is substantially continuous such that air located between the cover and the user's head and heated by said heating means is blocked from movement in and out of said cover.

2. The uniform heat distribution head protecting system of claim 1, wherein said heating means comprises:

a heat control switch;

a high heat heating element electrically connected to said heat control switch and formed in said cover in a substantially uniform arrangement;

a medium heat heating element electrically connected to said heat control switch and formed in said cover in a substantially uniform arrangement;

a low heat heating element electrically connected to said heat control switch and formed in said cover in a substantially uniform arrangement; and a ground wire electrically connected to said heat control switch at one end thereof, and electrically connected to said high, medium and low heating elements.

3. The uniform heat distribution head protecting system of claim 2, including a heat sensitive fuse electrically connected to said ground wire for opening a circuit when a temperature within said cover rises above a predetermined level.

4. The uniform heat distribution head protecting system of claim 1, including a pair of arcuate support members secured in said interior of said cover adjacent and parallel to said respective pair of notches, said support members being for supporting said cover above said ears of said user.

5. The uniform heat distribution head protecting system of claim 2, wherein said cover comprises:

a continuous outer transparent plastic sheet and an inner transparent plastic sheet;

a transparent vinyl sheet secured to said outer transparent plastic sheet within said interior portion; and a fleece sheet secured to said inner transparent plastic sheet within said interior portion, wherein said high, medium and low heat heating elements are positioned between said fleece sheet and said transparent vinyl sheet.

6. The uniform heat distribution head protecting system of claim 4, wherein said arcuate support members are constructed from a rigid plastic.

7. The uniform heat distributing head protecting system of claim 1, wherein said cover comprises:

an outer sheet being completely continuous without holes except for a hole formed by said outer perimeter for accepting the user's head and a hole through which a power cord for the heating means passes.

8. The uniform heat distributing head protecting system of claim 7, additionally comprising:

an inner sheet coextensive with said outer sheet; and said heating means comprising heating elements positioned between said inner and outer sheets.

9. A uniform heat distribution head protecting system comprising:

a cover formed to engage an upper portion of a user's head thereby enclosing hair of said user;

said cover including a pair of notches opposite of one another, said notches being adapted for receiving ears of said user;

an elastic band secured to an outer perimeter of said cover, said elastic band being for retaining said cover engaged to said user's head;

a heating means adapted for applying an adjustable uniform heat to a chemical applied to said hair of said user, said heating means being secured in an interior of said cover;

a power cord coupled to said heating means and extending outwardly through said cover;

a heat control switch for controlling the heating means, said heat control switch being positioned on a portion of the power cord exterior to the cover;

wherein said heating means includes a high heating element electrically connected to said heat control switch and positioned in said interior of said cover, a medium heating element electrically connected to said heat control switch and positioned in said interior of said cover, a low heating element electrically connected to said heat control switch and positioned in said interior of said cover, a ground wire electrically connected to said heat control switch at one end thereof, and electrically connected to said high, medium and low heating elements, and a heat sensitive fuse electrically connected to said ground wire for opening a circuit when a temperature within said cover rises above a predetermined level;

a pair of arcuate support members secured in said interior of said cover, each of said pair of support members being positioned adjacent to a respective one of said pair of notches, said support members being for supporting said cover above said ears of said user;

wherein said cover includes an outer transparent plastic sheet and an inner transparent plastic sheet, a transparent vinyl sheet secured to said outer transparent plastic sheet within said interior portion, and a fleece sheet secured to said inner transparent plastic sheet within said interior portion, wherein said high, medium and low heating elements are positioned between said fleece sheet and said transparent vinyl sheet; and wherein said arcuate support members are constructed from a rigid plastic.

* * * * *